US008574036B2

(12) United States Patent
Weiland

(10) Patent No.: US 8,574,036 B2
(45) Date of Patent: Nov. 5, 2013

(54) MACHINING STATION AND APPARATUS FOR MACHINING A WORKPIECE

(75) Inventor: Josef Weiland, Bad Wurzach (DE)

(73) Assignee: Lissmac Maschinenbau GmbH, Bad Wurzach (DE)

( * ) Notice: Subject to any disclaimer, the term of this patent is extended or adjusted under 35 U.S.C. 154(b) by 0 days.

(21) Appl. No.: 13/480,521

(22) Filed: May 25, 2012

(65) Prior Publication Data

US 2012/0295523 A1 Nov. 22, 2012

Related U.S. Application Data

(63) Continuation of application No. PCT/EP2010/007078, filed on Nov. 23, 2010.

(30) Foreign Application Priority Data

Nov. 27, 2009 (CN) ..... 10 2009 055 974

(51) Int. Cl.
*B24B 21/00* (2006.01)

(52) U.S. Cl.
USPC ..... 451/299; 451/300; 451/303; 451/309; 451/311

(58) Field of Classification Search
USPC ..... 451/59, 296, 299, 300, 303, 309, 311
See application file for complete search history.

(56) References Cited

U.S. PATENT DOCUMENTS 1,932,092 A * 10/1933 Etchart ..... 451/300
2,904,937 A 9/1959 Feurich
3,686,798 A * 8/1972 CoPresti ..... 451/300
3,859,757 A * 1/1975 Heesemann ..... 451/300
4,837,984 A * 6/1989 David ..... 451/57
4,930,259 A * 6/1990 Kobylenski et al. ..... 451/303

(Continued)

FOREIGN PATENT DOCUMENTS

DE 31 03 556 A1 8/1982
DE 33 08 606 A1 9/1984

(Continued)

OTHER PUBLICATIONS

Hans Dienst, "*Brenngeschnittene Werkstücke Gezielt Entgraten*," Werkstatt and Betrieb, vol. 23, No. 11, Nov. 1, 1990, pp. 865-867.
German Search Report dated May 20, 2010.
International Search Report and Written Opinion dated Feb. 25, 2011.

*Primary Examiner* — Eileen P. Morgan
(74) *Attorney, Agent, or Firm* — Burr & Brown

(57) ABSTRACT

An apparatus for machining a planar metal workpiece, having at least one machining unit, with which a machining belt, which is driven in circulation, can be guided in an at least approximately linear manner past the region of the workpiece to be machined in an oblique or transverse manner with respect to a feed direction of the workpiece. A movable carrier element having pressure means acts on a rear side of the machining belt in order to influence contact, necessary for machining, between the working side of the machining belt and the workpiece. A drive arrangement, by way of which the carrier element can be motor-driven, is provided such that the carrier element moves substantially parallel to the direction of movement of the machining belt, at least in the working region of the machining belt.

13 Claims, 3 Drawing Sheets

(56) References Cited

U.S. PATENT DOCUMENTS

| | | | | |
|---|---|---|---|---|
| 5,193,317 | A * | 3/1993 | Nordquist et al. | 451/53 |
| 5,443,415 | A * | 8/1995 | Shebanow et al. | 451/302 |
| 6,001,004 | A * | 12/1999 | Botteghi | 451/168 |
| 6,299,517 | B1 * | 10/2001 | Weber | 451/309 |
| 7,614,935 | B2 * | 11/2009 | Weiland | 451/11 |
| 2008/0207097 | A1 * | 8/2008 | Weiland | 451/301 |

FOREIGN PATENT DOCUMENTS

| | | | |
|---|---|---|---|
| DE | 10 2006 043 220 | A1 | 3/2007 |
| EP | 0 187 624 | A2 | 7/1986 |
| NL | 8 801 575 | A | 1/1990 |

* cited by examiner

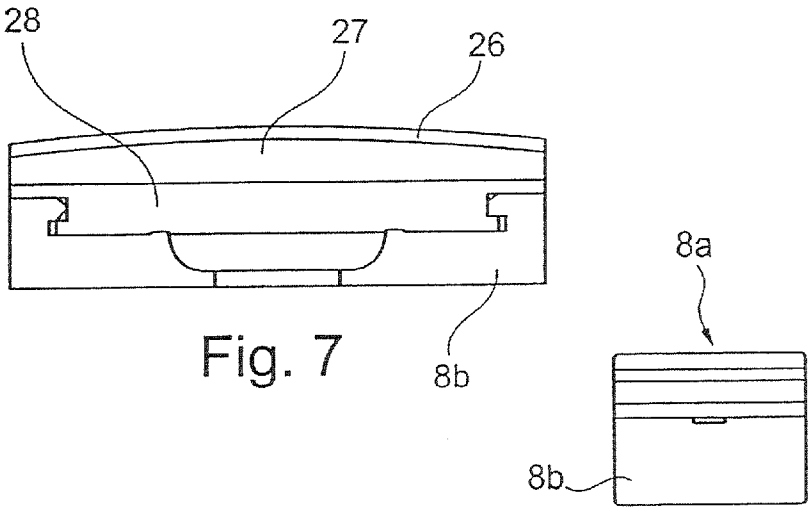
Fig. 8
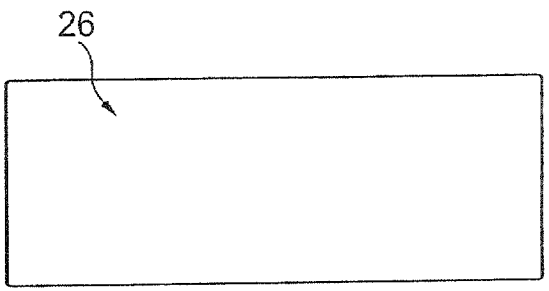
Fig. 7
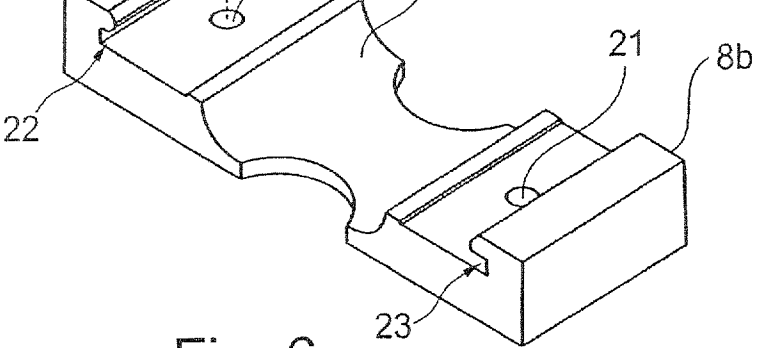
Fig. 9
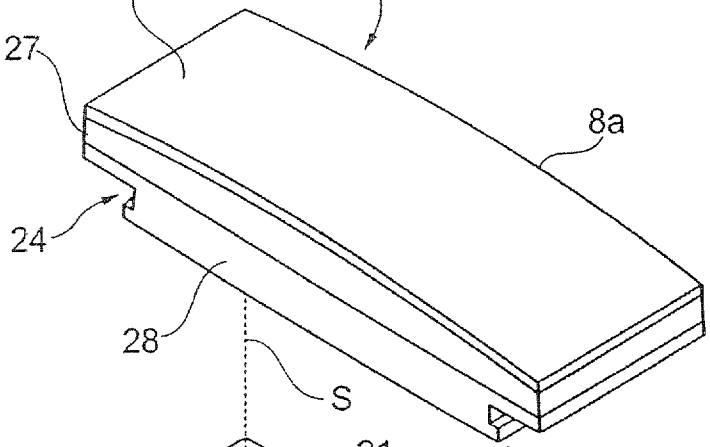
Fig. 5
Fig. 6

MACHINING STATION AND APPARATUS FOR MACHINING A WORKPIECE

CROSS REFERENCE TO RELATED APPLICATIONS

This application is a continuation of International Application No. PCT/EP2010/007078 filed Nov. 23, 2010, which designated the United States, and claims the benefit under 35 USC §119(a)-(d) of German Application No. 10 2009 055 974.4 filed Nov. 27, 2009, the entireties of which are incorporated herein by reference.

FIELD OF THE INVENTION

The invention relates to a machining station and an apparatus for machining a workpiece.

BACKGROUND OF THE INVENTION

Machining apparatuses for machining metal workpieces by removing material, e.g. burnishing machines, grinding machines or deburring machines, are known. In this case, use is made, for example, of circulating machining materials, such as friction belts or grinding belts, which run past regions of the workpiece that are to be machined, a working side of the belt being moved in the direction of the workpiece. In order to be able to influence the machining action, in particular during preparation for removing protruding or rough material regions even of highly profiled workpieces, various pressure mechanisms have hitherto been realized for machining belts, but these pressure mechanisms are not yet entirely satisfactory.

SUMMARY OF THE INVENTION

It is the object of the invention to improve an apparatus of the kind mentioned at the beginning from technical and economic points of view, in particular with regard to preliminary or rough machining of profiled metal workpieces having comparatively pronounced burr formation or noticeable material protrusions.

The invention first of all proceeds from an apparatus for machining a strip- or plate-like metal workpiece, in particular for deburring cut edges and/or for grinding surfaces of the workpiece, having at least one machining unit, with which a machining belt, which is driven in circulation, can be guided in an at least approximately linear manner past the workpiece in an oblique or transverse manner with respect to a feed direction of the workpiece in a working region of the machining belt, and in the process the workpiece can be machined via a working side of the machining belt, wherein pressure means present on a movable carrier element act on a rear side of the machining belt in order to influence contact, necessary for machining, between the working side of the machining belt and the workpiece. In this case, the workpiece is moved past the working region of the machining belt, or in relation thereto, in a manner resting on a conveying table. The conveying table can comprise in particular a driven conveying belt or driven conveying rollers.

The working side of the closed machining belt is formed on the outer side thereof and faces the workpiece in order to make contact therewith. For machining, the working side is designed for removing material, for example equipped with a multiplicity of tool-like machining elements or provided with a rough hard-material surface or a grain, in the manner for example of a sandpaper grinding belt.

The core of the invention can be seen in the fact that there is provided a drive arrangement, by way of which the carrier element can be motor-driven, such that the carrier element having the pressure means moves substantially parallel to the direction of movement of the machining belt, at least in the working region of the machining belt.

In this way, undesired friction or abrasion of the friction partners, which comprise the pressure means and the rear side of the machining belt, can easily be minimized.

Hitherto, pressure means have been positioned in a virtually immovable manner or in a fixed position pressing against the machining belt. If necessary, the pressure means have been able to yield slightly perpendicularly to the direction of movement or to the running direction of the machining belt.

This is associated with friction between the pressure means and the machining belt, said friction acting over the entire rear side of the machining belt.

Thus, in this regard, on account of the action of the pressure means, considerable friction effects, i.e. increased abrasion, soiling or wear and the development of friction heat, occur, these being undesired consequences as a whole. In addition to a reduced expected service life of the friction partners, this is associated with increased outlay on maintenance. Moreover, a considerable decline in the machining action over time has hitherto had to be accepted. The abovementioned disadvantages can be avoided, or at least greatly minimized, according to the invention.

With regard to the drive arrangement, the carrier element having the pressure means can be driven in particular independently of the circulating machining belt, for example via a separate drive. In this case, a movement with or without a movement reversal, that is to say, for example, moving back and forth or continuously in one direction, is possible in principle. In addition, it is advantageous for a separate drive or a drive that serves only for the movement of the carrier element to be present. In principle, a direct drive or an indirect drive of the carrier element can be provided. In addition to separate drive units for the machining belt and the carrier element, which is advantageous, it is also possible for a common drive unit to be present, wherein the machining belt and carrier element can be brought respectively to different drive speeds via corresponding transmissions or step-up or step-down transmission.

Preferably, the carrier element is in the form of a circulating endless element on which the pressure means are present such that the pressure means press noncontinuously on the rear side of the machining belt. According to the invention, the pressure means act only on a part of the working region in which the machining belt can come into contact with the workpiece, for example above the conveying table, and thus defines a maximum surface area, with which the pressure means can simultaneously come into contact, of the rear side of the machining belt. In between, the rear side of the machining belt remains free. The partial application of pressure or force, or the pressure contact, on fractions of the overall surface area in question in the working region of the rear side of the machining belt thus leaves gaps without contact between adjacent pressure regions on the rear side of the machining belt.

The formation of gaps between the pressure means is intended precisely to avoid application of pressure over the entire area or largely over the entire area of the rear side of the machining belt in the working region in question of the machining belt. The gap, interrupted by the pressure means, on the rear side of the machining belt is present on both sides of a pressure surface to which pressure is applied and extends as far as the next pressure surface or as far as the end of the working region. As a rule, the machining belt is deflected upwardly or downwardly via deflecting rollers or the like into the working region or away from the latter in the two end regions of the working region.

With the gaps, less drive force is required compared with pressure over the entire area, and so the drive arrangement for driving the machining belt or the endless element can be designed with lower power. In particular, the drive for the endless element can be chosen with smaller dimensions or to be more cost effective.

The endless element can in particular be in the form of a belt, chain and/or cord. Preference is given to a belt, which is oriented in the working region at least virtually parallel to the machining belt and extends at a specifiable distance therefrom. The structure and/or dimensions of the circulating endless element can be coordinated with the desired pressure action. In particular, the endless element has a width dimension, that is to say transversely to the circulation direction, which corresponds to the width of the machining belt.

Instead of a circulating endless belt, use can also be made of an element which in some other way brings about a movement of the pressure means substantially parallel to the direction of movement of the machining belt. The element can be mounted in a displaceable manner for example in a plane or be configured in the manner of an oscillation plate which moves back and forth in a manner driven via an eccentric, for example.

However, in this case, a standstill mark can arise on the workpiece at the reversal point of the back and forth movement, and this should be taken into consideration or can possibly make corresponding remachining of the workpiece necessary.

It is further proposed that a supporting arrangement which acts in the working region of the machining belt is provided. The supporting arrangement thus acts in the manner of a counter-bearing in the region in which the endless element acts on the rear side of the machining belt via the pressure means. The supporting arrangement is in particular provided to be able to apply the necessary force by way of the pressure means and in the process to prevent deflection or bending of the endless element upward or to allow this only to a specifiable degree. Furthermore, any deflections in the direction of the supporting arrangement and thus vibrations of the endless element in the working region, in particular at relatively high circulatory speeds, can be greatly minimized.

Advantageously, the supporting arrangement comprises a bearing section for supporting the endless element, such that the endless element can deflect in a restorable manner in a direction away from the workpiece. Thus, unevenness or depressions in and elevations on the workpiece can be reached by the machining element. In this case, the starting point is a start setting, as a result of which a pressure action is achieved by the pressure means for example by the position of the endless element together with the pressure means being set in relation to the machining belt in a manner dependent on the thickness or height of the workpiece. With regard to this basic setting, the endless element having the pressure means can be deflected somewhat back from the workpiece on account of elevations on the workpiece and can return to the basic position again when an elevation is no longer acting. The maximum possible deflection path for the endless element can in particular be settable via the specifiable movement path of the bearing section.

Preferably, the bearing section supports the rear side of the endless element in a manner acted upon by a spring force. Thus, the endless element having the pressure means can act on the machining belt via the spring force, such that the working side of the machining belt is pressed against the workpiece with a sufficiently high force. The working side of the machining belt can thus reach all protruding or lower regions on the workpiece at any time.

Moreover, it is proposed that the bearing section for supporting the endless element comprises a plurality of support elements which are positioned alongside one another in the direction of the longitudinal extent of the endless element and are movable with respect to a positionally fixed part via prestressed spring means. As a result, the degree or, if appropriate, the nature of the deflecting movement does not have to be the same or uniform over the entire working region when, for example, different support elements have different degrees of resilience. Thus, the support can act in a manner subdivided into segments, thereby making different deflecting movements of the endless element or of the machining belt possible in different sections of the working region. Thus deflecting movements of different degrees can be realized with each support element, in particular at the same time, this being advantageous when different workpieces or workpieces having different degrees of elevations or depressions are machined.

In principle, a support element can be movable in a resilient manner parallel to the rear side of the endless element or at an angle thereto. Thus, during the machining operation, even when the machining belt, and thus if appropriate the endless element, is positioned at an angle to the starting orientation of the machining belt, the support can be adapted in a corresponding manner to this angle or inclination.

In the case of harder spring arrangements for mounting the circulating endless means, a greater degree of surface machining is achieved. If, by contrast, the spring force of the spring means is chosen to be lower, depressions in and elevations on or edge sections of the workpiece can be machined better.

In particular, it is advantageous that mounting the pressure elements on a belt makes it possible to set these elements and thus also the machining belt at an angle on the working side in relation to the workpiece. Thus, it is possible to machine even particular formations and oblique edges or regions located lower than a surface of the workpiece.

The bearing section rests preferably in a planar manner against a rear side of the endless element over a width thereof. Thus, the support can take place uniformly over the entire width for a given longitudinal section of the machining belt. In particular in the case of planar workpiece sections to be machined, this serves for more uniform surface machining.

It is further advantageous that the pressure means comprise at least one detachably attached pressure element on a front side, directed toward the machining belt, of the endless element. Thus, optionally differently formed endless elements can advantageously be attached. Thus, it is also advantageously possible to replace damaged or worn pressure elements.

It is particularly advantageous that the pressure means comprise a basic part, on which there is at least one pressure element which presses against the rear side of the machining belt.

According to a preferred embodiment, the pressure element comprises elastically yielding sections which, in the state pressing against the rear side of the machining belt, allow the pressure element to yield elastically. The elastic portions can be located in particular inside the pressure element. Thus, the pressure element itself can perform a compensating movement, as a result of which an angle or adaptation to a differently formed workpiece surface is possible. Profiled sections of the workpiece can thus be machined even better. The pressure element can be equipped on its front side, which comes into contact with the rear side of the machining belt, with a friction-resistant material, so that the durability of the pressure element or of the machining belt is advantageously increased.

It is moreover advantageous that the drive arrangement is configured to drive the endless element and the machining belt at different speeds in the same direction of movement. Thus, the friction between the pressure means and the machining belt on the rear side of the machining belt can be kept comparatively low on account of the comparatively small relative movement between the pressure means carried along by the endless element and the machining belt. Furthermore, this also helps to keep the development of heat on account of the friction mentioned low. The workpiece is therefore heated only to a relatively small degree. Furthermore, on account of the residual relative movement between the endless element and the machining belt for a machining phase in question, it is not always the same points on the working side of the machining belt that are pressed against the workpiece, which is undesired and would lead to excessively worn regions and to regions which are not worn or are scarcely worn, but rather all of the regions of the working side of the machining belt are worn uniformly.

Advantageously, given the same direction of movement as the machining belt, the speed of the endless element is somewhat lower than the speed of the machining belt.

However, an identical speed of the endless element having pressure means and the machining belt is not ruled out. There is then no friction between these parts. Nevertheless, on account, for example, of different belt lengths, it is not always the same regions of the machining belt that are worn in operation, since the positions in which action by the pressure means takes place only takes place in the working region and changes regularly on account of the circulation of the two belts.

It is particularly advantageous that the endless element is configured in order, in the installed state of the endless element, to remove and/or replace at least individual pressure elements arranged on the endless element. The number and/or configuration of the pressure elements arranged on the endless element can therefore be formed in a particularly variable manner. Given a higher number of pressure elements, the machining intensity can be increased.

It is further advantageous that the endless element is configured to attach differently configured pressure elements thereto. Thus, the endless element can be equipped, in particular in a variable manner, with pressure elements, for example depending on the type of workpieces to be machined.

In particular, it is advantageous that the pressure element is attached in a detachable manner to the endless element via a sliding fit. A sliding fit allows the pressure element to be removed or attached in a particularly easy manner. It is also advantageous that it is possible to replace a pressure element by way of a handle or without a tool.

The invention also relates to a machining station for machining a strip- or plate-like metal workpiece, said machining station having a finishing unit having a finishing belt for machining the workpiece, wherein, according to the invention, an apparatus, which is connected in front of the finishing unit, is present, said apparatus being configured as per one of the abovementioned apparatuses. The basic idea behind this arrangement is that a smaller, lightly driven grinding belt is positioned, for example, in front of a flap belt, said smaller grinding belt having regions against which the pressure elements only partially press, it being possible to change the position of said pressure elements with respect to the workpiece. Thus, workpieces in one unit can initially be freed of course burrs and the like, before finishing by the finishing can effectively take place. Without the machining apparatus connected in front, a desired high machining quality in particular of workpieces having a large number of burrs or material protrusions could not be achieved in one unit.

BRIEF DESCRIPTION OF THE DRAWINGS

The invention is explained in more detail by way of exemplary embodiments according to the invention, which are illustrated in the figures.

FIG. 5 shows a perspective view obliquely from above of a sliding shoe;

FIG. 6 shows a perspective view obliquely from above of a mount for the sliding shoe according to FIG. 5; and FIGS. 7 to 9 show views from the front, from the side and from above of the sliding shoe and the mount according to FIGS. 5 and 6 in the assembled state.

DETAILED DESCRIPTION OF THE INVENTION

Figure 1:
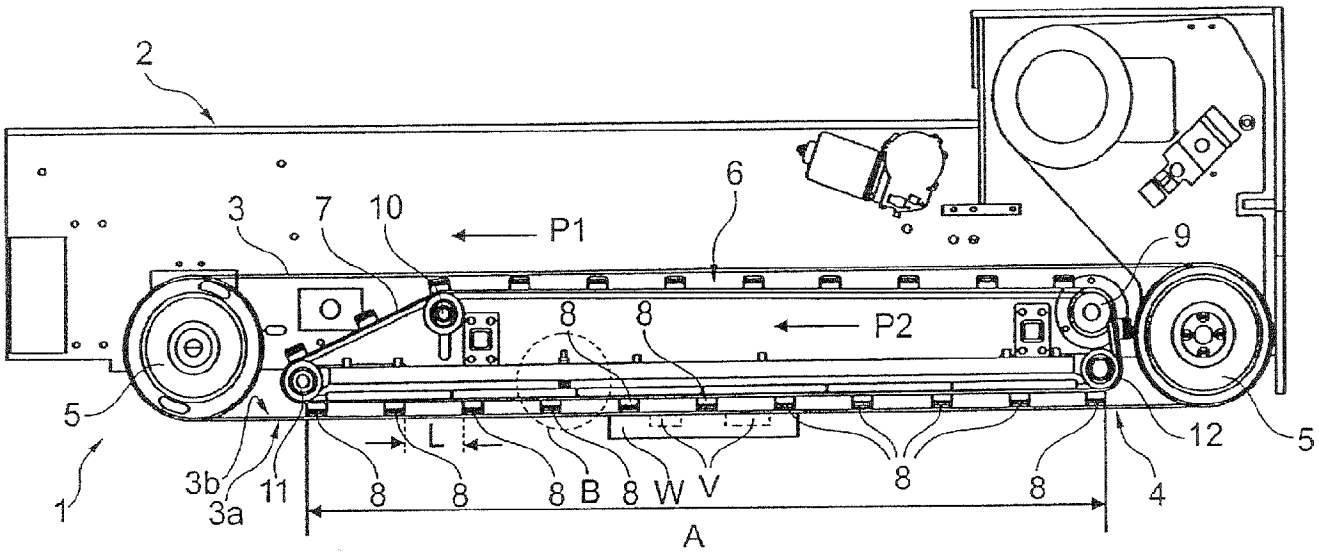
FIG. 1 shows a front view of a part of a machining station having a machining apparatus according to the invention.

FIG. 1 shows a front view of a part of a machining station having a machining apparatus 1 according to the invention having a machine body 2 and a machining belt 3. The machining station is in the form in particular of a machine unit. Not illustrated is a transporting arrangement for guiding past a flat workpiece W to be machined underneath the machining belt 3. By way of the transporting arrangement, which comprises for example a conveying belt which is driven in movement, the workpiece W can be moved through the machining station transversely to a bottom longitudinal edge 4 of the machining belt 3, said longitudinal edge 4 extending parallel to the plane of the drawing.

In the machine body 2 having a housing, a finishing unit (not illustrated in more detail), which has a finishing belt or flap belt for final finishing of the workpiece W, is connected after the machining apparatus 1. Accordingly, in this arrangement, the machining apparatus 1 serves in particular for rough machining of the workpiece 1 and is connected in front of the finishing unit in the transporting direction of the workpiece W.

In the exemplary embodiment illustrated, the machining apparatus 1 is in the form of a belt grinding machine in particular for deburring cut edges and/or for grinding surfaces of the plate-like workpiece W which has depressions V. The workpiece W can be for example a metal component which has been cut out of a steel plate by a laser method or torch welding method.

The machining belt 3 is configured as a grinding belt and has a correspondingly configured working side 3*a*, for example having sand grains. The rear side 3*b* of the machining belt 3 can be driven in a guided manner over two rotating drums 5, wherein one of the two drums 5 is driven in rotation via a drive (not illustrated), in particular having an electric motor. In operation, the machining belt 3 is driven in circulation for example in the direction of the arrow P1 or counterclockwise and is guided transversely or obliquely past the workpiece W in a linear manner.

In principle, machining belt 3 can also circulate in the clockwise direction. Furthermore, the workpiece, which is machined from above via the machining apparatus 1, can also be machined from below by a machining apparatus (not shown) located correspondingly on the underside.

The circulatory speed of the machining belt 3 can be specified in particular in a stepless manner.

In order that the working side 3*a* of the machining belt 3 or of the grinding belt is pressed against the workpiece W with a sufficiently great force or in a suitably adapted orientation, there is an endless element 6, which is driven in circulation and has a carrier belt 7 having pressure elements or pressure shoes 8 on its outer side. In operation, the endless element 6 circulates in particular in the same direction as the machining belt 3, that is to say in the counterclockwise direction or in the direction P2 according to FIG. 1, but more slowly than the machining belt 3. As a result, not always the same points on the machining belt 3 are subjected to pressure in the working region during continuous operation, and the entire working side 3*a* is worn uniformly in particular over the service life of the machining apparatus 1, this being advantageous.

Furthermore, the relative movement between the pressure shoes 8 and the rear side 3*b* of the machining belt 3 is kept comparatively low by the movement of the pressure shoes 8 in the direction of movement of the machining belt 3, and so wear on the rear side 3*b* of the machining belt 3 is minimized, this likewise counteracting otherwise premature failure of the endless element 6 on account of individual points wearing through.

The endless element 6 is coordinated with the machining belt 3 such that the pressure shoes 8 press against the rear side 3*b* of the machining belt 3, at least in a working region A of the machining belt 3, and thus press the working side 3*a* against the workpiece W, as a result of which a corresponding application of pressure or force for workpiece machining is realized. The circulatory speed of the endless element 6 is advantageously somewhat lower than the circulatory speed of the machining belt 3, it being essential for high machining quality that the endless element 6 is oriented at least virtually parallel to the machining belt 3 in the working region A. Over the length of the working region A, a comparatively small position change or angular position of the endless element 6 and of the machining belt 6 is deliberately provided, for example via the belt tension, which can be set in each case in a corresponding manner, and so not just a flat surface of the workpiece W but also the depressions V or edges can be ground by the working side 3*a* without defects.

Figure 2:
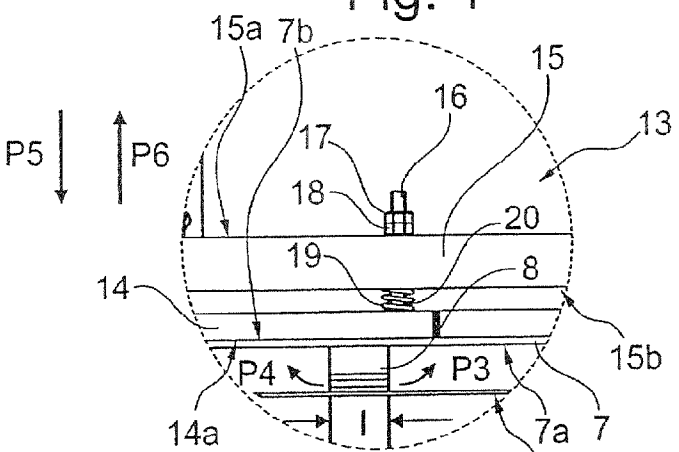
FIG. 2 shows an enlarged detail from FIG. 1.

The ability to adapt the machining belt 3 individually to the shape of the workpiece, in particular the angular position of the pressure shoes 8, is additionally enhanced by the comparatively short length dimension l of the pressure shoes 8 in the circulatory or longitudinal direction. The possible angular positions of the pressure shoe 8, starting from the neutral orientation according to FIG. 2, is indicated by the movement arrows P3 and P4 in FIG. 2.

In the exemplary embodiment shown, the carrier belt 7 has a multiplicity of pressure shoes 8 which are spaced apart equally from one another and each have the same length dimension l. In the exemplary embodiment shown, the intermediate space which is thus present in each case between adjacent pressure shoes 8 and has a length dimension L is advantageously approximately three times the size of the length dimension l of a pressure shoe 8. However, for different applications, other length ratios L to l or length dimensions l and L can be advantageous. It is also conceivable for not all of the pressure shoes 8 or intermediate spaces on an endless element to have the same length l or L, but, for example, for all of them to be different or to conform in alternation.

As FIG. 1 shows, it is also advantageously possible to provide a partial pressure surface, or one with gaps, instead of a full-area pressure surface on the rear side 3*b* of the machining belt 3.

Therefore, less drive power is required for the belts 3, 7 and, on account of the lower degree of friction, less friction heat arises, this being noticeable primarily in the metal workpiece W.

Thus, the workpiece W can readily be further processed immediately after intensive grinding, for example manually by a person without using protective measures such as gloves. A cooling phase can be dispensed with as a rule.

On account of the low surface pressure by means of the pressure shoes 8 on the rear side 3*b* of the machining belt 3, the endless element 6 can be driven for example via a comparatively low-power drive motor (not illustrated), which drives a drive roller 9 about which the endless element 6 is guided in movement. In order to guide and deflect the carrier belt 7 there are further, but nondriven, guide rollers 10, 11 and 12.

In order to provide a counter-bearing or resilient support, up to a specifiable degree, of the carrier belt 7, or in order to provide a possible positional adaptation, as per the arrows P6 and P5 (see FIG. 2), of the carrier belt 7, a supporting arrangement 13 having support elements in the form of bearing elements 14 is provided. The carrier belt 7 is thus stabilized on the rear side between the guide rollers 11 and 12.

In the exemplary embodiment shown, six bearing elements 14 are provided and rest in a planar manner by way of an underside 14*a* against the rear side 7*b* of the carrier belt 7. The bearing elements 14 are each mounted in a manner acted upon by a spring force or are each held in a resilient manner on a continuous and positionally fixed holding rail 15. Resilient holding is realized for each bearing element 14 via in each case two threaded pins 16 having an external thread, which are present on the rear side of the bearing element 14 and engage through the holding rail 15 through corresponding bores in the latter. The threaded pins 16 project from the top side 15*a* of the holding rail 15, and so the distance of the bearing elements 14 from the holding rail 15 and thus the absolute position of the bearing elements 14 is defined via threaded nuts 17, 18 or the screw-on position thereof. In order to space the bearing elements 14 apart from the holding rail 15, prestressed spiral springs 19 about each threaded pin 16 are clamped between an underside 15*b* of the holding rail 15 and a top side of the bearing elements 14. Directly above the bearing element 14, a further threaded nut 20 is screwed onto the threaded pin 16, the spiral spring 19 engaging around said threaded nut 20.

If, during the machining process, the workpiece W is guided through underneath the machining belt 3 in the working region A, the machining belt 3 can deflect upward, as per arrow P6 in FIG. 2, counter to the spring force of the spiral spring 19. If a region of the working side 3*a*, the rear side of which is acted upon by a pressure shoe 8, arrives at a depression in the workpiece W, on account of the stressed spiral spring 19 the machining belt is pressed downward in the direction of arrow P5 or can be positioned at an angle as per arrows P3 and P4 (see FIG. 2), such that desired edge or surface machining of the workpiece W can take place effectively and fully by means of the machining belt 3 moved past.

A spring action on the machining belt 3 can be set, or correspondingly higher or lower pressure forces can be selected, via the type, number and position or the spring constant of the spiral springs 19. The characteristic of the angular position of the pressure shoes 8 can also be influenced via the spiral springs 19. With harder spiral springs, surface machining can be targeted more, whereas with softer spiral springs, grinding of profiled or contoured regions of the workpiece can be carried out in a more intensive or improved manner.

Instead of the spiral springs 19 shown, other springs, such as plate springs, for example, or other elastic elements can also be used, for example buffer elements of the rubber buffer type.

FIGS. 5 and 6 show the pressure shoe 8 in detail, having a sliding shoe 8*a*, which is releasably accommodated in a sliding show carrier 8*b*. The sliding shoe carrier 8*b* provides a sliding fit for the sliding shoe 8*a*, it being possible to connect the sliding shoe carrier 8*b* to the carrier belt 7 via bores 21 by way of appropriate connecting means such as screws 30, for example (see FIG. 3). The screw 30 engages along the axis S (FIGS. 5 and 6) into the sliding shoe 8*a* in order to fix it to the sliding shoe carrier 8*b*.

Appropriate undercuts 22, 23 are provided laterally on the sliding shoe carrier 8*b* for the sliding fit, said undercuts 22, 23 being coordinated with corresponding rib sections 24, 25 on the sliding shoe 8*a*. The sliding shoe 8*a* has in particular a somewhat domed or convex top side 26, which relates to a layer which consists of a comparatively friction-resistant material. An inwardly adjoining further layer 27 of the sliding shoe 8*a* can consist of a comparatively yielding or elastic material, for example a rubber or foam material. Therefore, the sliding shoe 8*a* itself can behave in a resilient or yielding manner, and this possibly brings about even better contact between the machining belt 3 and the workpiece W. A bottommost layer 28, having the rib sections 24, 25, of the sliding shoe 8*a* is made of a comparatively hard material. Similarly, the sliding shoe carrier 8*b*, which has a depression or a concave section 29 in the middle.

Figure 3:
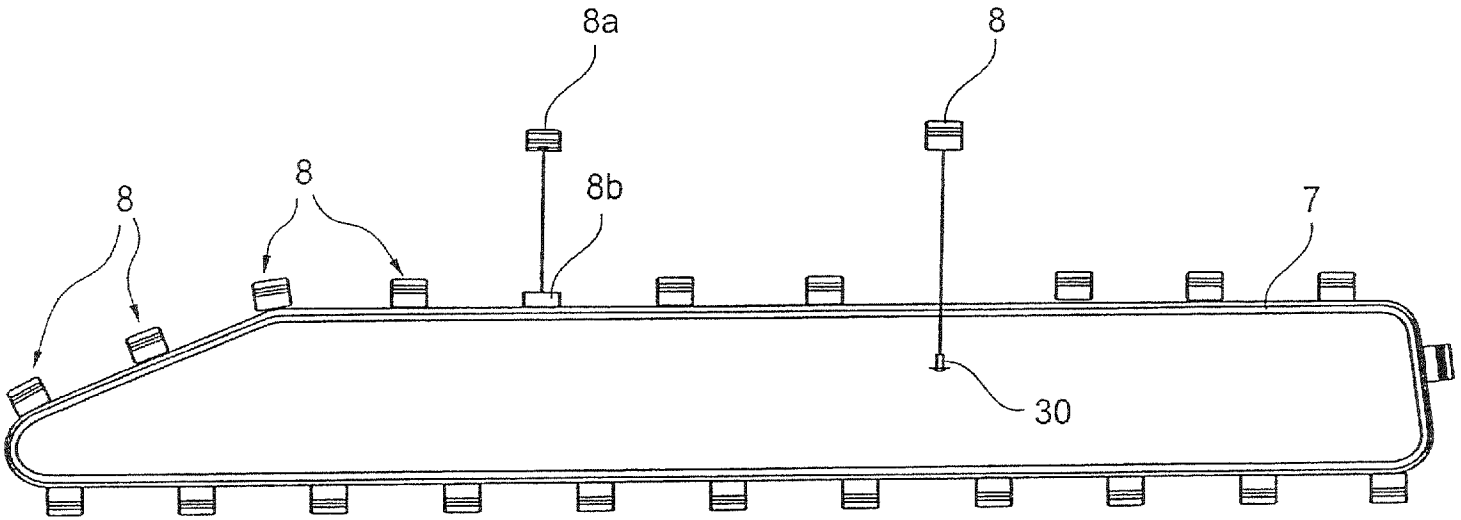
FIG. 3 shows an individual front-side illustration of an endless element of the machining apparatus according to FIG. 1.
Figure 4:
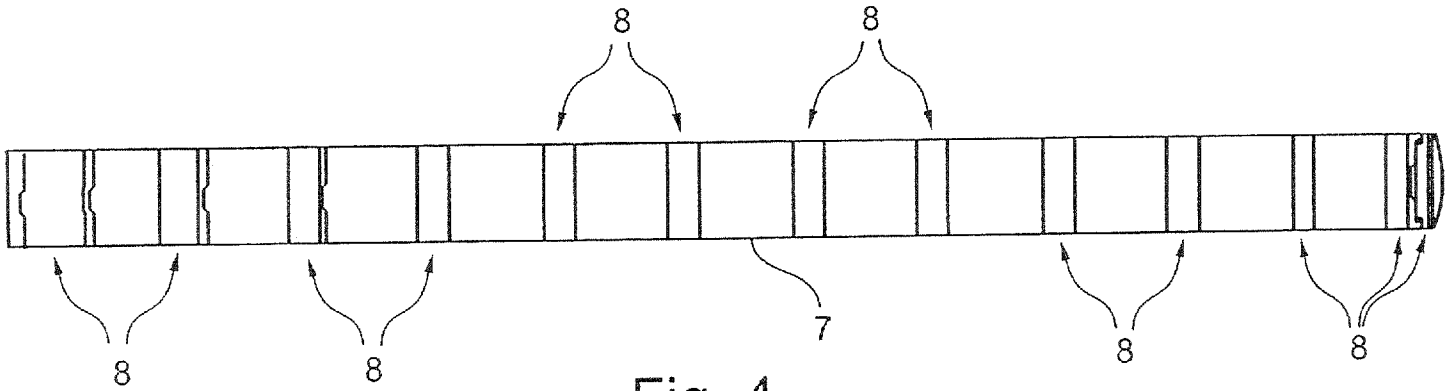
FIG. 4 shows the endless element according to FIG. 3 from above.

FIGS. 3 and 4 show individual illustrations of the endless element 6, once from the front and once from above, the attachment via attachment screws 30 in order to fix the sliding shoe carrier 8*b* to the carrier belt 7 being shown by way of example.

LIST OF REFERENCE SIGNS

1 Machining apparatus
2 Machine body
3 Machining belt
3*a* Working side
3*b* Rear side
4 Longitudinal edge
5 Drum
6 Endless element
7 Carrier belt
7*a* Front side
7*b* Rear side
8 Pressure shoe
8*a* Sliding shoe
8*b* Sliding shoe carrier
9 Drive roller
10 Guide roller
11 Guide roller
12 Guide roller
13 Supporting arrangement
14 Bearing elements
14*a* Underside
15 Holding rail
15*a* Top side
15*b* Underside
16 Threaded pin
17, 18 Threaded nut
19 Spiral spring
20 Threaded nut
21 Bore
22 Undercut
23 Undercut
24, 25 Rib section
26 Top side
27 Layer
28 Layer
29 Section
30 Screw

The invention claimed is:

1. An apparatus for machining a planar metal workpiece having at least one machining unit comprising:

a machining belt that is driven in circulation in an at least approximately linear manner past the workpiece in an oblique or transverse manner with respect to a feed direction of the workpiece in a working region of the machining belt a movable carrier element;

pressure means present on the movable carrier element for acting on a rear side of the machining belt in order to ensure contact, necessary for machining, between a working side of the machining belt and the workpiece, wherein the pressure means has pressure elements that contact both the movable carrier element and the machining belt to form points of contact therebetween, and wherein the pressure elements are separated by a distance, which is multiples of a width size of the pressure elements, whereby previously formed points of contact are not always subjected to pressure in the working region of the machine belt; and a drive arrangement by which the carrier element is motor-driven, such that the carrier element moves substantially parallel to the direction of movement of the machining belt at least in the working region of the machining belt.

2. The apparatus as claimed in claim 1, wherein the carrier element is in the form of a circulating endless element on which the pressure means are present, such that the pressure means press noncontinuously on the rear side of the machining belt.

3. The apparatus as claimed in claim 2, further comprising a supporting arrangement that acts in the working region of the machining belt.

4. The apparatus as claimed in claim 3, wherein the supporting arrangement comprises a bearing section for supporting the endless element, such that the endless element can deflect in a restorable manner in a direction away from the workpiece.

5. The apparatus as claimed in claim 4, wherein the bearing section for supporting the endless element comprises a plurality of support elements which are positioned alongside one another in the direction of the longitudinal extent of the endless element and are movable with respect to a positionally fixed part via prestressed springs.

6. The apparatus as claimed in claim 4, wherein the bearing section rests in a planar manner against a rear side of the endless element over a width thereof.

7. The apparatus as claimed in claim 1, wherein the pressure means comprise at least one detachably attached pressure element on a front side, directed toward the machining belt, of the endless element.

8. The apparatus as claimed in claim 1, wherein the pressure element comprises elastically yielding sections which, when pressing against the rear side of the machining belt, allow the pressure element to yield elastically.

9. The apparatus as claimed in claim 1, wherein the drive arrangement is configured to drive the endless element and the machining belt at different speeds in the same direction of movement.

10. The apparatus as claimed in claim 1, wherein the endless element is configured such that at least individual pressure elements arranged on the endless element can be removed for replacement without uninstalling the endless element from the apparatus.

11. The apparatus as claimed in claim 1, wherein the endless element is configured to attach differently configured pressure elements thereto.

12. The apparatus as claimed in claim 1, wherein the pressure element is attached in a detachable manner to the endless element via a sliding fit.

13. A machining station for machining a planar metal workpiece, comprising a finishing unit having a finishing belt for machining the workpiece, and an apparatus as claimed in claim 1 connected in front of the finishing unit.

* * * * *

UNITED STATES PATENT AND TRADEMARK OFFICE

CERTIFICATE OF CORRECTION

PATENT NO. : 8,574,036 B2
APPLICATION NO. : 13/480521
DATED : November 5, 2013
INVENTOR(S) : Josef Weiland It is certified that error appears in the above-identified patent and that said Letters Patent is hereby corrected as shown below:

Title Page, Item (30), Foreign Application Priority Data

Please change: "Nov. 27, 2009 (CN) ..... 10 2009 055 974" to -- Nov. 27, 2009 (DE) ..... 10 2009 055 974 --

Title Page, Item (56), OTHER PUBLICATIONS

Please change: "Hans Dienst, "*Brenngeschnittene Werkstücke Gezielt Entgraten*," Werkstatt and Betrieb, vol. 23, No. 11, Nov. 1, 1990, pp. 865-867." to -- Hans Dienst, "*Brenngeschnittene Werkstücke Gezielt Entgraten*," Werkstatt und Betrieb, vol. 23, No. 11, Nov. 1, 1990, pp. 865-867 --

Signed and Sealed this
Twenty-second Day of April, 2014

Michelle K. Lee

Michelle K. Lee
*Deputy Director of the United States Patent and Trademark Office*